US006332474B1

(12) United States Patent
Haugen et al.

(10) Patent No.: US 6,332,474 B1
(45) Date of Patent: Dec. 25, 2001

(54) METHOD FOR COLLECTING A VISCOUS AND STICKY MATERIAL

(75) Inventors: Karl T. Haugen, Blentarp; Gert Lövgren, Bjärred, both of (SE)

(73) Assignee: Disab Vacuum Technology AB, Lund (SE)

( * ) Notice: Subject to any disclaimer, the term of this patent is extended or adjusted under 35 U.S.C. 154(b) by 0 days.

(21) Appl. No.: 09/614,869

(22) Filed: Jul. 12, 2000

Related U.S. Application Data

(63) Continuation of application No. PCT/SE98/00051, filed on Jan. 14, 1998, now abandoned.

(51) Int. Cl.[7] ..... F04F 3/00

(52) U.S. Cl. ..... 137/13

(58) Field of Search ..... 137/13

(56) References Cited

FOREIGN PATENT DOCUMENTS

| | | |
|---|---|---|
| 4101184 A1 | 7/1992 | (DE) . |
| 4222873 A1 | 1/1994 | (DE) . |
| 199090 | 6/1923 | (GB) . |
| 130389 | 8/1974 | (NO) . |
| 464804 B | 6/1991 | (SE) . |

*Primary Examiner*—Gerald A. Michalsky
(74) *Attorney, Agent, or Firm*—Browdy and Neimark

(57) ABSTRACT

When collecting a crude oil material or a similar highly viscous and sticky material, a lubricating fluid is supplied and vacuum is applied.

3 Claims, No Drawings

METHOD FOR COLLECTING A VISCOUS AND STICKY MATERIAL

This application is a continuation of parent application No. PCT/SE98/00051, filed Jan. 14 1998 now abandoned.

The present invention relates to a method for collecting a highly viscous and sticky material.

The combating of oil pollution on the open sea and on land is a constant problem to which a large number of more or less inefficient solutions have been found, such as chemical means of combating, drag nets, mechanical beaters etc. A great difficulty in the combating of crude oil is, as is known, the highly viscous and sticky state of the crude oil, making it difficult to collect and transport.

Moreover, a discharge of crude oil can in itself be polluted with various solid particles, dirt and litter, which make the collecting procedure difficult.

When storing and transporting crude oil, for instance in tankers, crude oil sediment forms, which may contain both mud and sand. Also when cleaning oil tanks for e.g. crude oil, considerable difficulties arise when removing such settled crude oil residues. A special problem is that settled crude oil material and other highly viscous and sticky materials, when being sucked up, tend to stick to collecting equipment, such as tubes, nozzles and pump equipment.

There is today a great need for an efficient method of cleaning crude oil tanks in e.g. tankers since cleaning on the open sea with sea water, which is presently a common method, results in the discharge of oil and constitutes an environmental hazard.

SE-B-432,274 discloses a method for collecting a layer of crude oil from an area covered therewith. In the method described, water vapour is used to break up the oil layer and to heat the same, thereby reducing its viscosity.

This method of collecting oil, however, still involves the problem that settled oil tends to stick to the collecting equipment although the oil has been heated and broken up.

An object of the invention is to provide a relatively uncomplicated method for efficient combating of crude oil pollution.

A specific object is to provide an improved method for collecting a highly viscous and sticky material from an area covered with such material in the form of a layer.

In this connection a specific object is to provide an improved method for collecting settled oil layers, which permits efficient cleaning of crude oil tanks.

According to the invention, the objects are achieved by a method according to the appended claims.

In summary, the invention is based on the surprising discovery that the removal of an undesired oil can be facilitated by the paradoxical addition of a further oil.

It is assumed that the lubricating function of the supplied liquid fluid facilitates the passing of the collected oil material through ducts in the collecting equipment and, thus, prevents adhesion and depositing in the collecting equipment. This improved capacity of transporting crude oil and similar substances dramatically increases the collecting capacity of existing collecting equipment since the number of shutdowns, planned and unplanned, decreases. Besides the cost of service and maintenance will decrease.

An advantage of the inventive method is that it is not necessary to heat the fluid supplied to the material which is to be removed. A further advantage is that it is not necessary to supply the material under pressure either, but the supply can be effected in an arbitrary manner.

According to an embodiment of the invention, the lubricating fluid comprises an oil, which in itself is advantageous since no further polluting substances, which can make the disposal difficult, are thus supplied to the crude oil material.

The invention is applicable not only to the combating of oil and collecting of oil from e.g. oil depots, but also to the collecting, from areas or depots, of other sticky and highly viscous materials, such as bituminous products, mud etc.

The invention has been found particularly advantageous when cleaning oil tanks, in which settled crude oil material containing impurities, such as precipitates, mud and sand, is deposited and possibly sticks to bottom and walls.

A preferred embodiment of the invention will now be described. Reference is made to crude oil material, by which, in connection with the invention, is meant crude oil and similar highly viscous and sticky materials. In particular, the designation crude oil material is intended to comprise materials settled in the storage and/or transport of crude oil.

In a preferred method of collecting a crude oil material or a similar highly viscous and sticky material, a lubricating fluid consisting of hydrocarbon compounds is supplied to the material which is to be removed.

The actual removal is carried out by means of vacuum via collecting equipment with collecting ducts. The collecting equipment usually comprises tubes, nozzles, couplings and pump equipment, through which the crude oil material is pumped.

In the collecting procedure, the oil or a similar product which is to be removed is pumped through a tube, the opening or nozzle of which is placed adjacent to or in the oil. From the tube, the oil is passed to a collecting vessel for disposal or further treatment.

The adding of the lubricating fluid can be carried out separately before and/or during the collecting procedure. In a preferred embodiment of the invention, lubricating fluid is added in connection with the collecting via a combined nozzle for sucking up crude oil material and supplying a lubricating fluid.

If there is a long transport distance and/or a great resistance in suction ducts in the collecting equipment, it may be advantageous to supply lubricating oil along the ducts, between the crude oil material that is to be transported and the duct wall.

The proportions between lubricating fluid and collected oil material depend on a number of different factors, such as temperature, transport distance, choice of lubricating fluid and properties of the oil that is to be collected.

The choice of lubricating fluid is not critical as long as the lubricating function is achieved. What is decisive of a good function thus is above all that the lubricating fluid, in the existing circumstances, such as temperature, pressure, material to be collected and material in the collecting equipment, is capable of reducing the friction between the material that is being collected and the collecting equipment, such that there is but a negligible degree of adhesion.

A type of fluid which has been found very useful is various types of lubricating liquids, such as oils, e.g. motor oil, hydraulic oil and waste oil.

The use of a waste oil also gives the advantage that a residual product of little value that must be disposed of in any case, can be used and then be disposed of together with the collected crude oil material.

A great advantage of the method according to the invention is that when collecting viscous and sticky materials, it is possible to control the collecting procedure to fit the material concerned.

What is claimed is:

1. A method for collecting a highly viscous and sticky crude oil material from a tank, in which method a fluid is supplied to the material and vacuum is applied, characterized in that a lubricating fluid in the form of waste oil which is not crude oil is supplied to the crude oil material adjacent to an inlet of collecting equipment, and that the waste oil is sucked through a collecting duct together with the crude oil material for the purpose of preventing adhesion to the collecting equipment.

2. A method as claimed in claim 1, wherein the waste oil is supplied without any preceding heating.

3. Use of a waste oil when collecting a highly viscous and sticky crude oil material from a tank, for the purpose of preventing adhesion between the crude oil material and collecting equipment.

* * * * *